United States Patent [19]

Nishida et al.

[11] Patent Number: 4,741,381

[45] Date of Patent: May 3, 1988

[54] METHOD OF AND APPARATUS FOR AUTOMATICALLY CONTROLLING PRESSURE IN HOLDING FURNACE INCORPORATED IN LOW PRESSURE DIE-CASTING SYSTEM

[75] Inventors: Tadashi Nishida; Shinichi Kondo; Tetsuji Matsui, all of Toyokawa, Japan

[73] Assignee: Sintokogio Ltd., Nagoya, Japan

[21] Appl. No.: 3,897

[22] Filed: Jan. 16, 1987

[30] Foreign Application Priority Data

Jan. 22, 1986 [JP] Japan ..... 61-11698
Feb. 28, 1986 [JP] Japan ..... 61-44353
Mar. 14, 1986 [JP] Japan ..... 61-57941

[51] Int. Cl.[4] ..... B22D 17/32
[52] U.S. Cl. ..... 164/457; 164/155
[58] Field of Search ..... 164/154, 155, 119, 306, 164/457

[56] References Cited

U.S. PATENT DOCUMENTS 3,861,457 1/1975 Py ..... 164/155
4,585,050 4/1986 Merrien et al. ..... 164/457

FOREIGN PATENT DOCUMENTS 59-73169 4/1984 Japan ..... 164/457

*Primary Examiner*—Nicholas P. Godici
*Assistant Examiner*—Richard K. Seidel
*Attorney, Agent, or Firm*—Armstrong, Nikaido, Marmelstein & Kubovcik

[57] ABSTRACT

Disclosed is a method of and an apparatus for automatically controlling the pressure in a holding furnace incorporated in a low pressure die-casting system in accordance with a desired pattern. A proportional pressure control valve operated by a microcomputer is provided in a pressurized gas supply circuit for supplying pressurized gas into the holding furnace. The pressure in the holding furnace is changed in accordance with a pattern which is as close as possible to a desired pressurization pattern by sending to the proportional pressure control valve a command value obtained by adding to an input command value of the proportional pressure control valve a correction value calculated by a predetermined computing method.

7 Claims, 4 Drawing Sheets

METHOD OF AND APPARATUS FOR AUTOMATICALLY CONTROLLING PRESSURE IN HOLDING FURNACE INCORPORATED IN LOW PRESSURE DIE-CASTING SYSTEM

BACKGROUND OF THE INVENTION

1. Field of the Invention

The present invention relates to a method of and an apparatus for controlling the pressure in a holding furnace incorporated in a low-pressure diecasting system. More specifically, the present invention relates to a method of and an apparatus for controlling by a microcomputer a proportional pressure control valve provided in a pressurized gas supply circuit for supplying gas under pressure to a holding furnace.

2. Prior Art

In order to change the pressure in a holding furnace of a low pressure die-casting apparatus in accordance with a preselected time—pressure characteristic curve (hereinafter referred to as a "desired pressurization pattern"), it has recently been proposed to provide a proportional pressure control valve in a circuit which supplies pressurized gas into the holding furnace, and to operate that proportional pressure control valve by means of a microcomputer. The proportional pressure control valve is constructed such that the secondary pressure is set when the opening of the valve's sleeve is closed by balancing the attraction force of a proportional solenoid and a force generated by the secondary pressure acting on the end surface of a spool via a feedback path provided in the sleeve.

However, such proportional pressure control valves suffer from certain problems. That is, when the pressure of the holding furnace is increased to a predetermined desired pressure, such a control pattern inevitably arises wherein the pressure within the holding furnace oscillates about the desired pressure, having an amplitude which gradually decreases and finally converges to the desired pressure. Such a pressure oscillation causes the level of molten metal in the cavity of a mould to go up and down, resulting in defects in casting. It takes time to bring the valve into an operable condition which allows gas under a predetermined pressure to flow therethrough when any of various current values is sent as a command signal. In other words, there is a time lag between the input of the command signal and the occurrence of gas flow under a predetermined pressure. As a result, when the pressure in the holding furnace is to be controlled in accordance with a desired pressurization pattern by changing the pressure of the gas to be supplied to the furnace as time elapses, the pressure may not actually be changed on the basis of that pattern. Further, there is a limitation to the size of proportional pressure control valves, and this makes it impossible for a valve to deal with the demand for provision of a larger sized holding furnace which requires a larger amount of pressurized gas.

SUMMARY OF THE INVENTION

In the present invention, the above discussed and other problems and deficiencies are overcome by sending a command value V which is obtained by adding a correction value Vd calculated by a predetermined computing method to an input command value Vo for the proportional pressure control valve. In addition, in accordance with the present invention, a main pressurized gas supply circuit for supplying a large amount of pressurized gas is provided in parallel to the pressurized gas supply circuit incorporating the proportional pressure control valve so as to cope with a large-size holding furnace.

Accordingly, a first object of the present invention is to provide a method of increasing the pressure of a holding furnace to charge molten metal into the cavity of a mould such that the level of the molten metal in the mould cavity always goes up, thereby it is possible to prevent the occurrence of defects in casting.

A secondary object of the invention is to provide a method of operating a proportional pressure control valve by a microcomputer which is capable of overcoming the problems caused by the time lag occurring in the operation of the proportional pressure control valve.

A third object of the invention is to provide a method of operating by a microcomputer a pressurized gas supply circuit and a proportional pressure control valve incorporated therein which is modified to copé with a large-sized holding furnace.

A fourth object of the present invention is to provide an apparatus for automatically controlling the pressure in a holding furnace employing a proportional pressure control valve operated by a microcomputer.

Other objects and advantages of the present invention will be understood when the present invention is explained in more detail with reference to the accompanying drawings in which.

DESCRIPTION OF THE PREFERRED EMBODIMENTS

Figure 1:
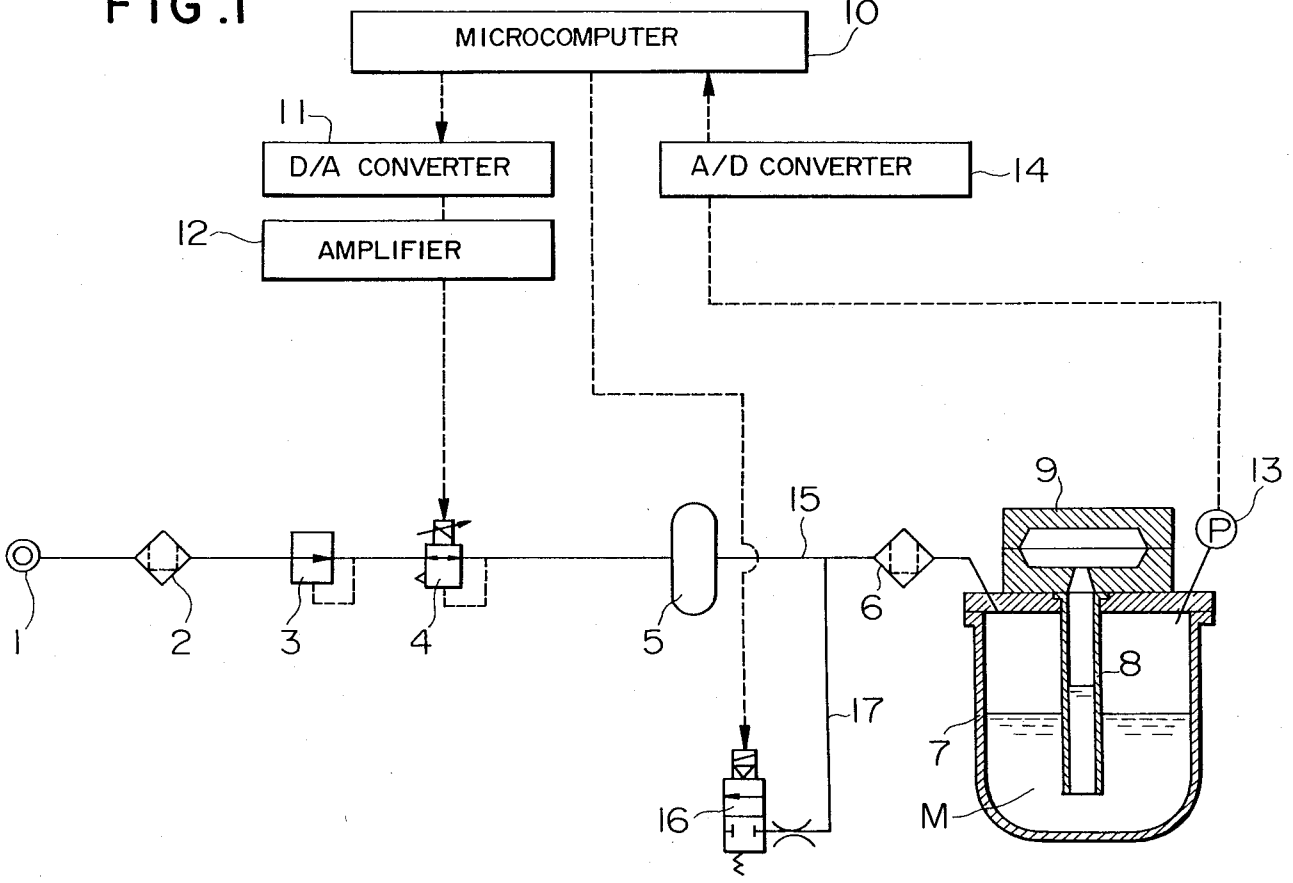
FIG. 1 is a schematic view of a first embodiment of a pressure control apparatus according to the present invention.

Referring first to FIG. 1, a compressed air source 1 communicates with a holding furnace 7 for molten metal via a mist separator 2, a pressure reducing valve 3, a proportional pressure control valve 4, a surge tank 5, a conduit 15 and a filter 6. The holding furnace 7 has a sealed structure which allows the molten metal M to be retained therein without lowering its temperature. The interior of the holding furnace 7 communicates with a mould 9 located above the holding furnace 7 through a stoke tube 8. A microcomputer 10 is adapted to store in its memory section various desired pressurization patterns associated with the holding furnace 7, input command values Vo of the proportional pressure control valve 4 and gains G. The gain G represents a conversion rate used for converting a pressure $kg/cm^2$ to a voltage V. The microcomputer 10 is electrically connected to the proportional pressure control valve 4 via a D/A converter 11 for converting a digital signal to an analog signal and an amplifier 12. The holding furnace 7 is provided with a pressure sensor 13 for detecting the pressure therein. The pressure sensor 13 is electrically connected to the microcomputer 10 via an A/D converter 14 for converting an analog signal to a digital signal. A solenoid valve 16 is adapted to communicate with the conduit 15 through a branch pipe 17, and is electrically connected to the microcomputer 10.

Operation of the thus-arranged device will be hereinunder described. Any of the desired pressurization patterns and the gains G which have been stored in the microcomputer 10 is selected, and the pressure of the pressure reducing valve 3 is set at a desired value. The solenoid valve 16 is left closed. In this state, when a command for starting the pouring of the molten metal is inputted to the microcomputer 10, the compressed air generated by the compressed air source 1 is supplied to the holding furnace 7 by being passed through the mist separator 2 by means of which the mists contained therein are removed, the pressure reducing valve 3 at which the pressure of the air is reduced to an adequate value, the proportional pressure control valve 4, the surge tank 5, the conduit 15 and the filter 6. As a result, the molten metal M in the holding furnace is pressurized and is thereby charged into the mould 9 through the stoke tube 8. During this molten metal charging process, the pressure in the holding furnace 7 is changed in accordance with the desired pressurization pattern by the proportional pressure control valve 4 controlled by the microcomputer 10. The operation of the proportional pressure control valve 4 by the microcomputer 10 is conducted as follows: a desired pressure $P_{i+1}$ at a time $t_{i+1}$ which is a unit of time ahead of a time $t_i$ is read from the selected desired pressurization pattern at first. Next, the input command value Vo of the proportion pressure control valve 4 which corresponds to that desired pressure $P_{i+1}$ is read out. Generally, a unit of time may be set at about 0.2 seconds, although it differs depending on the capacity of the employed pressurized gas supply circuit. In the meantime, a pressure $P_m$ in the holding furnace 7 at the time $t_i$ is detected by the pressure sensor 13, and the signal representing the detected pressure is inputted to the microcomputer 10 through the A/D converter 14. By the input of the pressure signal, pressure deviation $\Delta P$ between the pressure $P_m$ in the holding furnace 7 and the desired pressure $P_{i+1}$ is calculated, and the result is then multiplied by the gain G to obtain a correction value Vd. Subsequently, this correction value Vd is added to the command value Vo to obtain a command value V, and this value V is sent as a command signal to the proportional pressure control valve 4 via the D/A converter 11 and the amplifier 12. The above sequence of operations are successively repeated each moment of time. Consequently, the holding furnace 7 is supplied with the pressure controlled compressed air, and the molten metal is pressurized at a pressure changed in accordance with a pattern which is close to the desired pressurization pattern, and is charged into the mould 9. After the completion of charging of the molten metal M, the solenoid valve 16 is opened for a preselected time so as to allow the compressed air to be discharged from the holding furnace 7.

The applicant have found the fact that it is desirable to set the input command signal for the proportional pressure control valve such that the input command signal has a value with which the desired pressure gives a stady-state condition. However, with the thus set input command signal a delay in the response of the internal pressure of the holding furnace cannot be neglected.

Accordingly, is highly effective to use the value V which is obtained by adding the value Vd determined by the above-mentioned calculation to the input command value Vo in order to minimize the above-mentioned delay in the response of the internal pressure of the holding furnace with no pressure oscillation.

Figure 2:
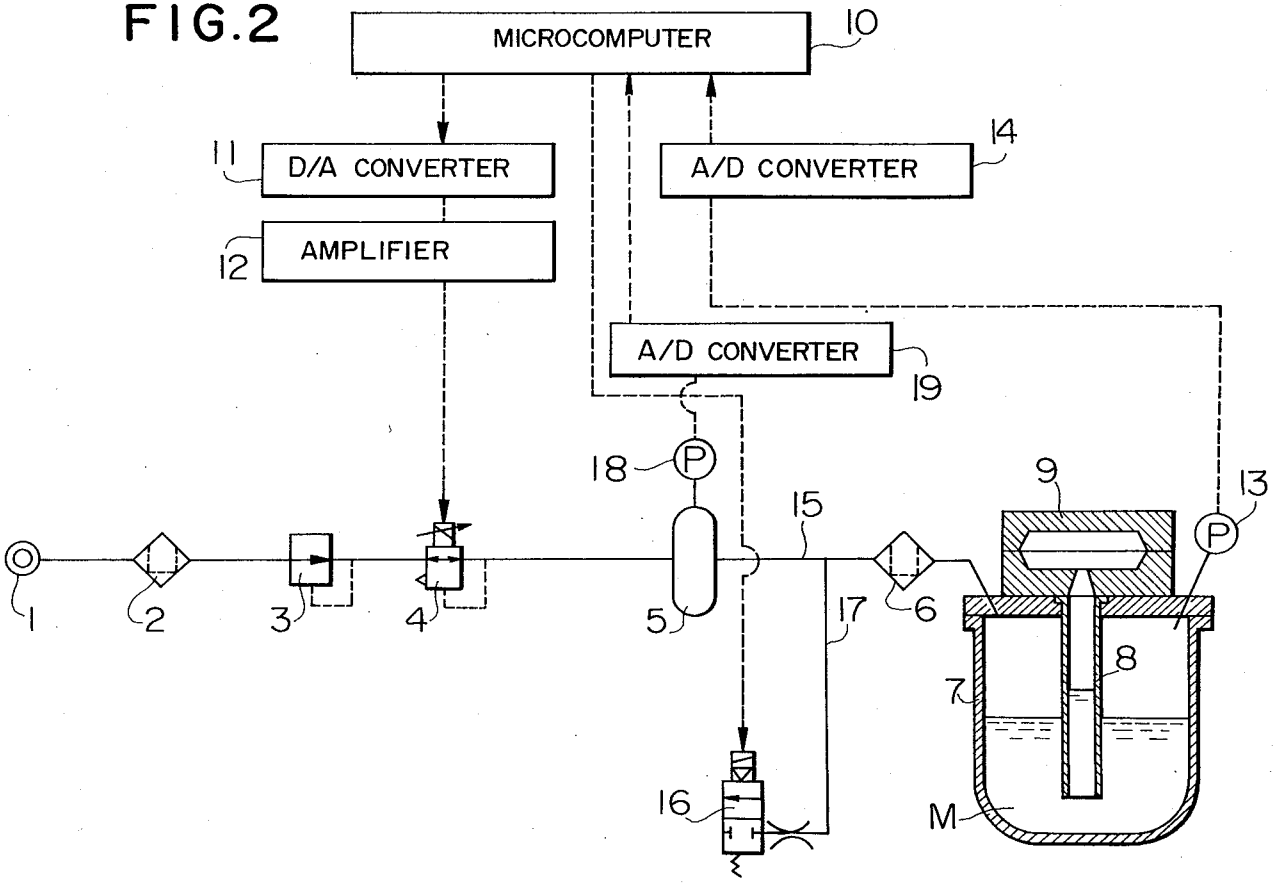
FIG. 2 is a schematic view of a second embodiment of the pressure control apparatus according to the present invention.

It is possible to change the pressure in the holding furnace in accordance with a pattern which is closer to the desired pressurization pattern during the charging of the molten metal by providing the surge tank 5 with a pressure sensor 18 for detecting the pressure therein, as shown in FIG. 2 which illustrates a second embodiment of the present invention, and by electrically connecting that pressure sensor 18 to the microcomputer 10 through a D/A converter 19. The apparatus of this embodiment is basically the same in structure as that of the first embodiment but is different therefrom with respect to the operation of the microcomputer 10 as follows: the desired pressure $P_{i+1}$ at the time $t_{i+1}$ which is a unit of time ahead of the time $t_i$ is read out from the desired pressurization pattern. Next, the input command value Vo of the proportional pressure control valve 4 which corresponds to the desired pressure $P_{i+1}$ is read out. In the meantime, the pressure Ps in the surge tank 5 at the time $t_i$ is detected by the pressure sensor 18, and the signal representing the detected pressure is inputted to the microcomputer 10 through the A/D converter 19. Simultaneously, the pressure Pm in the holding furnace 7 at the time $t_i$ is detected by the pressure sensor 13, and the signal representing the detected pressure is input to the microcomputer 10 through the A/D converter 14. By the input of the pressure signals of the surge tank 5 and the holding furnace 7 in the microcomputer, the pressure difference $\Delta P_1$ caused by air leakage which may occur in the holding furnace 7 is calculated. At the same time, as the pressure signal of the holding furnace 7 is inputted into the microcomputer 10, a pressure deviation $\Delta P_2$ between the pressure Pm in the holding furnace 7 and the desired pressure $P_{i+1}$ is calculated. Subsequently, the pressure deviation $\Delta P_2$ is multiplied by the gain G corresponding to the pressure difference $\Delta P_1$ to obtain a correction value Vd. The correction value Vd is added to the input command value Vo so as to obtain a command value V, and the command value V is input to the proportional pressure control valve 4 through the D/A converter 11 and the amplifier 12. The above sequence of operations are successively repeated each moment of time. Consequently, even if there is a difference in pressure of the compressed air in the holding furnace 7 and that of the compressed air temporarily stored in the surge tank 5 due to the air leakage, the molten metal M in the holding furnace 7 is pressurized at a pressure changed in accordance with a pattern which is close to the desired pressurization pattern. A unit of time, $\Delta t = t_{i+1} - t_i$, may be set at about 0.2 seconds, although it will differ depending on the capacity of the pressurized gas supply circuit.

Figure 3:
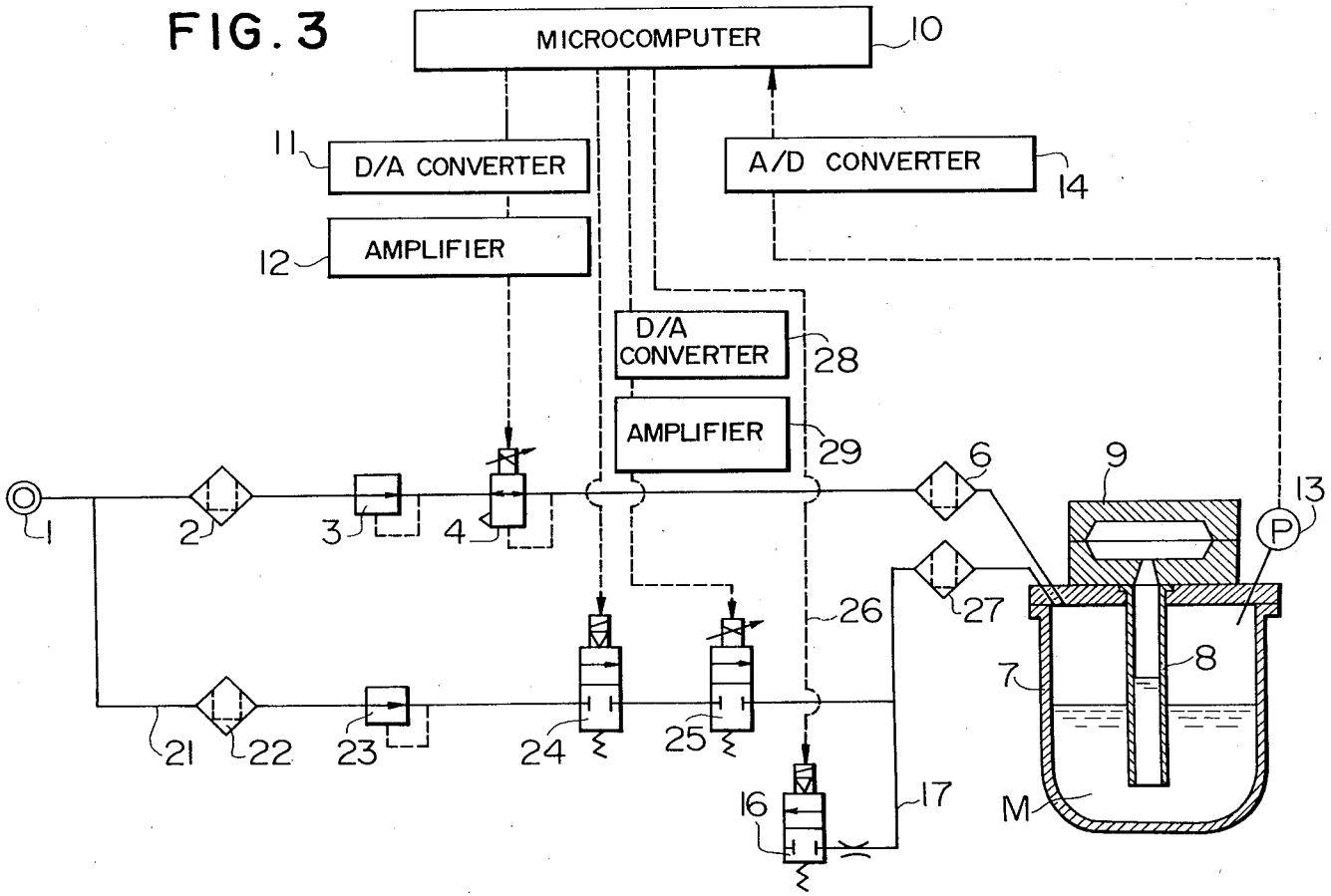
FIG. 3 is a schematic view of a third embodiment of the pressure control apparatus according to the present invention.
Figure 4:
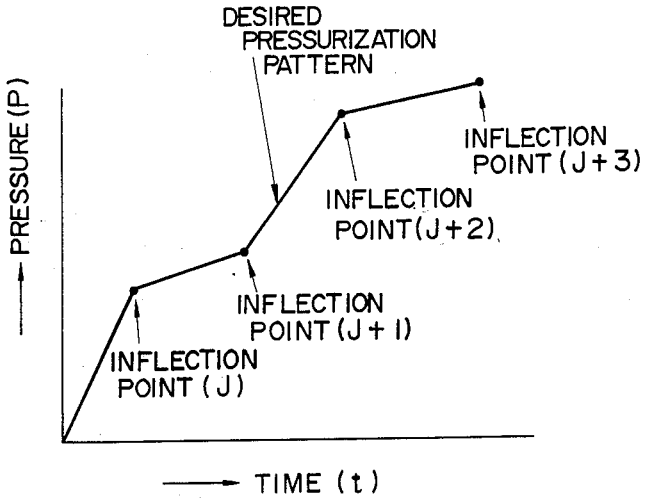
FIG. 4 shows a time—pressure characteristic curve of an example of a desired pressurization pattern.
Figure 5:
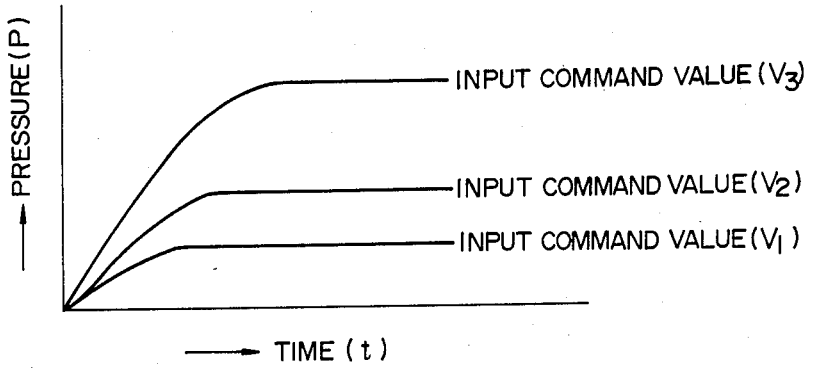
FIG. 5 shows a time—pressure characteristic curve of a proportional pressure control valve.

If a large amount of compressed air is necessary to pressurize the molten metal contained in the holding furnace in accordance with the desired pressurization pattern, the pressurized gas supply circuit may be modified as shown in FIG. 3 which represents a third embodiment of the present invention. In this apparatus, the compressed air source 1 also communicates with the holding furnace 7 for the molten metal through a second supply via a branch pipe 21, a mist separator 22, a pressure reducing valve 23, a solenoid valve 24, proportional flow rate control valve 25, branch pipe 17 and a filter 27. The solenoid valve 24 is adapted to be opened when a large amount of compressed air is required by the holding furnace 7. More specifically, the solenoid valve 24 is opened, during the intervals between the start and an inflection point J and between an inflection point J+1 and an inflection point J+2 shown in FIG. 4. The proportional flow rate control valve 25 is so constructed that the opening of the sleeve is controlled by a spool which is moved by the balance of the suction force of the proportional solenoid and the reaction force of a spring. The movement of the spool is changed by the value of current applied to the proportional solenoid, thereby controlling the flow rate. The compressed air source 1 also communicates with the holding furnace 7 via the mist separator 2, the pressure reducing valve 3, the proportional pressure control valve 4 and the filter 6. Reference numeral 10 denotes a microcomputer which stores various desired pressurization patterns, the input command values Vo of the proportional pressure control value 4, and the gains G. The microcomputer 10 is electrically connected to the proportional pressure control valve 4 and the proportional flow rate control valve 25 via the D/A converters 11, 28 and the amplifiers 12, 29, respectively. The holding furnace 7 has a pressure sensor 13 for detecting the pressure therein, which is also electrically connected to the microcomputer 10 via the A/D converter 14. The solenoid valve 16 communicates with the holding furnace 7 through the branch pipe 17, and is electrically connected to the microcomputer 10 as shown by the broken line 26. Reference numerals 8 and 9 designate the stoke tube and the mould, respectively.

The thus-arranged apparatus will be operated as follows: any of the desired pressurization patterns and the gains G is selected, and the pressure of the pressure reducing valves 3 and 23 is set at a desired value beforehand. The solenoid valve 24 is left closed. In this state, when a command for starting pouring of the molten metal is inputted to the microcomputer 10, the solenoid valve 24 is opened during the intervals within the preset desired pressurization pattern between the start point and the inflection point J and between the inflection point J+1 and the inflection point J+2, and the compressed air generated by the compressed air source 1 passes the mist separator 22, the pressure reducing valve 23 and the solenoid valve 24, and then reaches the proportional pressure control valve 25. At this time, the microcomputer 10 calculates the speed at which the pressure is raised during an interval within the desired pressurization pattern, for example, the pressure increasing speed during the interval between the inflection point J+1 and the subsequent inflection point J+2 on the basis of this desired pressurization pattern, as well as the opening of the proportional flow rate control valve 25 which is necessary to obtain a pressure increasing speed which is slightly smaller than the obtained speed. The result of the calculation is then sent to the proportional pressure control valve 25 via the D/A converter 28 and the amplifier 29, whereupon the compressed air is supplied to the holding furnace 7 so that the pressure in the holding furnace becomes slightly lower than that of the desired pressurization pattern. When the solenoid valve 24 is closed by the microcomputer a unit of time before the inflection point J+2 within the desired pressurization pattern, the sending of the signal to the proportional flow rate control valve 25 is simultaneously stopped. Concurrently with the above-described operation of the second supply of the compressed air, the compressed air is supplied to the holding furnace 7 through the first supply in the same manner as in the first embodiment after the pressure thereof is controlled by the proportional pressure control valve 4 as follows: when the compressed air reaches the proportional pressure control valve 4, in the microcomputer 10, the desired pressure $P_{i+1}$ at the time $t_{i+1}$ which is a unit of time ahead of the time thereof $t_i$ is read out from the desired pressurization pattern, and the input command value Vo of the proportional pressure control valve which corresponds to the desired pressure $P_{i+1}$ is then read out. In the meantime, the pressure Pm in the holding furnace 7 at the time $t_i$ is detected by the pressure sensor 13, and the signal representing the detected pressure is inputted to the microcomputer via the A/D converter 14. By the input of the pressure signal into the microcomputer, the pressure deviation $\Delta P$ is calculated from the desired pressure $P_{i+1}$ and the pressure Pm in the holding furnace 7, and this pressure deviation $\Delta P$ is multiplied by the gain G to obtain the correction value Vd. This correction value Vd is added to the input command value Vo to obtain the command value V, and the resultant command value V is sent to the proportional pressure control valve 4 via the D/A converter 11 and the amplifier 12. The above-described sequence of operations is successively repeated each moment of time. Consequently, the holding furnace 7 is concurrently supplied with the main compressed air through the branch pipe 21 and the compressed air for adjustment, whereby the molten metal M in the holding furnace 7 is pressurized in accordance with a pressure pattern which is close to the desired pressurization pattern, and is charged into the mould 9.

In the third embodiment, the flow rate of the compressed air which is passed through the branch pipe 21 is continuously and variably regulated by the proportional flow rate control valve 25. However, a fixed type flow rate control valve may be employed in place of the proportional flow rate control valve 25, if very fine adjustment is unnecessary.

Inactive gas such as nitrogen gas or argon gas may be employed as the pressurized gas in place of compressed air. In such a case, the mist separators 2 and 22 and the filters 6 and 27 can be eliminated.

As will be clear from the foregoing description, the proportional pressure control valve is controlled in accordance with the invention, by using a command value which is obtained by adding the correction value to the input command value of the proportional pressure control valve. As a result, the pressure in the holding furnace can be changed in accordance with a pattern which is close to the desired pressurization pattern. Further, in the third embodiment, the holding furnace is supplied with the main pressurized gas through the pressurized gas supply circuit having a large capacity as well as pressurized gas through the supply circuit having a small capacity. The method and the apparatus of the invention are therefore applicable to a large-sized holding furnace which requires a large amount of pressurized gas for control.

What is claimed is:

1. A method of automatically controlling the pressure in a holding furnace incorporated in a low pressure die-casting system by controlling the pressurized gas to be supplied to the molten metal holding furnace using a proportional pressure control valve operated by a microcomputer, comprising the steps of: reading out a desired pressure $P_{i+1}$ at a time $t_{i+1}$ which is a unit time ahead of a time $t_i$ from a desired pressurization pattern of the time—pressure curve associated with said holding furnace which has been stored in said microcomputer beforehand; reading out an input command value Vo corresponding to said desired pressure $P_{i+1}$ from the steady values of the output pressure which are associated with the input command values of said proportional pressure control valve, said input command values being stored in said microcomputer beforehand; detecting a pressure Pm in said holding furnace at said time $t_i$; calculating a pressure deviation $\Delta P$ from said desired pressure $P_{i+1}$ and said pressure Pm in said holding furnace; calculating a correction value Vd by multiplying said pressure deviation $\Delta P$ by a preset gain G; calculating an input command value V by adding said correction value Vd to said input command value Vo; and sending said input command value V to said proportional pressure control valve.

2. A method of claim 1 wherein the gas output from said proportional pressure control valve is temporarily stored in a surge tank before being introduced to said holding furnace, including the steps of: detecting a pressure Ps in said surge tank at said time $t_i$; calculating a pressure deviation ($\Delta P_1$) between said pressure Pm in said holding furnace and said pressure Ps in said surge tank; and setting said gain G in accordance with said pressure deviation ($\Delta P_1$).

3. A method of claim 1 wherein the pressurized gas is supplied to said holding furnace through a solenoid valve and a flow rate control valve separately from the supply of the pressurized gas to said holding furnace through said proportional pressure control valve, including the steps of: sending a signal for opening said solenoid valve at a time in said desired pressurization pattern which corresponds to an inflection point J+1 where the rate at which the pressure is raised increases with respect to time; and sending a signal for closing said solenoid valve before the time in said desired pressurization pattern which corresponds to an inflection point J+2 where the rate at which the pressure is raised decreases with respect to time.

4. A method of claim 3 wherein said flow rate control valve is a proportional flow rate control valve, including the steps of: calculating on the basis of said desired pressurization pattern the rate at which the pressure is raised between said inflection point J+1 and said subsequent inflection point J+2; sending to said proportional flow rate control valve a signal for opening said proportional flow rate control valve by a degree which ensures a pressure increasing speed which is slightly smaller than the result of said calculation simultaneously when the signal for opening said solenoid valve is sent to said solenoid valve; and stopping the sending of the signal to said proportional flow rate control valve at the time when the signal for closing said solenoid valve is sent to said solenoid valve before the time corresponding to said inflection point J+2.

5. An apparatus for automatically controlling the pressure in a holding furnace incorporated in a low pressure die-casting system, comprising: a pressurized gas source; a pressure reducing valve; a proportional pressure control valve and a surge tank which are connected in that order between said pressurized gas source and said holding furnace so as to introduce the gas from said pressurized gas source to the interior of said holding furnace; a first pressure sensor for detecting the inside pressure (Pm) of said holding furnace; a second pressure sensor for detecting the inside pressure (Ps) of said surge tank; a microcomputer for controlling said proportional pressure control valve; a first A/D converter for A/D-converting the output of said first pressure sensor and inputting the result to said microcomputer; a second A/D converter for A/D converting the output of said second pressure sensor and inputting the result to said microcomputer; a D/A converter for D/A converting the output of said microcomputer and sending the same to said proportional pressure control valve, wherein said microcomputer stores a desired pressurization pattern of the time—pressure curve associated with said holding furnace, as well as steady values of the output pressure which are associated with the input command values of said proportional pressure control valve, reads out a desired pressure $P_{i+1}$ at a time $t_{i+1}$ which is a unit of time ahead of a time $t_1$, reads out an input command value Vo of said proportional pressure control valve which corresponds to said desired pressure $P_{i+1}$, calculates a pressure deviation P from said desired pressure $P_{i+1}$ and said pressure Pm in said holding furnace which has been sent from said first pressure sensor, calculates a pressure deviation P, between the pressure Ps in said surge tank and the pressure Pm in said holding furnace, and sends to said proportional pressure control valve an input command value V which is obtained by adding to said input command value Vo a correction value Vd obtained by multiplying said pressure deviation P by a gain G set in accordance with said pressure deviation ($P_1$).

6. An apparatus for automatically controlling the pressure in a holding furnace incorporated in a low pressure die-casting system, comprising: a pressurized gas source, a first supply including a pressure reducing valve and a proportional pressure control valve which are connected in that order between said pressurized gas source and said holding furnace so as to introduce the gas from said pressurized gas source to the interior of said holding furnace; a second supply including a second pressure reducing valve, a solenoid valve and a flow rate control valve which are connected in that order between said pressurized gas source and said holding furnace for supplying gas to the interior of said holding furnace separately from said first supply; a pressure sensor for detecting the inside pressure of said holding furnace; a microcomputer for controlling said proportional pressure control valve and said solenoid valve; an A/D converter for A/D-converting the output of said pressure sensor and inputting the same to said microcomputer; a D/A converter for D/A converting the output of said microcomputer and sending the same to said proportional pressure control valve, wherein said microcomputer stores a desired pressurization pattern of the time—pressure curve associated with said holding furnace, as well as steady values of the output pressure which are associated with the input command values of said proportional pressure control valve, reads out a desired pressure $P_{i+1}$ at a time $t_{i+1}$ which is a unit of time ahead of a time $t_i$, reads out an input command value Vo of said proportional pressure control valve which corresponds to said desired pressure $P_{i+1}$, calculates a pressure deviation P from said desired pressure $P_{i+1}$ and said pressure Pm in said holding furnace which has been sent from said pressure sensor, and sends to said proportional pressure control valve an input command value V which is obtained by adding to said input command value Vo a correction value Vd obtained by multiplying said pressure deviation P by a present gain G; and sends to said solenoid valve a signal for opening said solenoid valve at a time in said desired pressurization pattern which corresponds to an inflection point J+1 where the rate at which the pressure is raised increases with respect to time, and a signal for closing said solenoid valve before the time corresponding to an inflection point J+2 where the rate at which the pressure is raised decreases.

7. An apparatus of claim 6, wherein said flow rate control valve is a proportional flow rate control valve, including a second D/A converter for D/A converting the output of said microcomputer whereby when the signal of opening said solenoid valve is sent to said solenoid valve, said microcomputer at the same time calculates on the basis of said desired pressurization pattern the speed at which the pressure is raised between said inflection point J+1 and the subsequent inflection point J+2, sents a signal for opening said proportional flow rate control valve by a degree which ensures a pressure increasing speed which is slightly smaller than that of the calculation result, and when the signal for closing said solenoid valve is sent to said solenoid valve before the time corresponding to said inflection point J+2, simultaneously stops the sending of the signal to said proportional flow rate control valve.

* * * * *